United States Patent [19]

Bertolet

[11] 3,974,999

[45] Aug. 17, 1976

[54] COMBINED STAPLE REMOVING AND RETRIEVING DEVICE

[76] Inventor: Carol F. Bertolet, 613 S. Kenmore St., Anaheim, Calif. 92804

[22] Filed: Sept. 3, 1974

[21] Appl. No.: 502,273

[52] U.S. Cl. ..... 254/28

[51] Int. Cl.[2] ..... B25C 11/00

[58] Field of Search ..... 254/28

[56] References Cited

UNITED STATES PATENTS

| | | | |
|---|---|---|---|
| 3,528,643 | 9/1970 | Munson et al. | 254/28 |
| 3,598,367 | 8/1971 | Ghibely | 254/28 |
| 3,630,486 | 12/1971 | Foitle | 254/28 |
| 3,761,057 | 9/1973 | Nembhard et al. | 254/28 |
| 3,766,647 | 10/1973 | Steiner | 30/6.4 |

*Primary Examiner*—Al Lawrence Smith
*Assistant Examiner*—Robert C. Watson
*Attorney, Agent, or Firm*—W. C. Babcock

[57] ABSTRACT

A combined staple removing and retrieving device that includes two pivotally connected elongate ferrous members of channel shaped transverse cross section that define first and second claws on first ends thereof, which claws at least partially overlap one another when the device is pivoted from a first position to a second position to remove a staple from a number of papers through which the staple extends. The device in a first form includes a permanent magnet means that retrieve a staple and hold it in a first removable position on the device after the first and second claws have removed the staple from a number of papers. In a second form of the invention the claws are permanently magnetized to retrieve a staple after it has been removed from a fastening position. A third form of the invention employs permanently magnetized spring means to not only maintain the first and second members in a first position but to retrieve a staple after it is removed from a fastening position. A fourth form of the device employs spring means to retrieve and hold a removed staple after the staple has been removed from engagement with a number of sheets of papers.

3 Claims, 7 Drawing Figures

FIG. 1
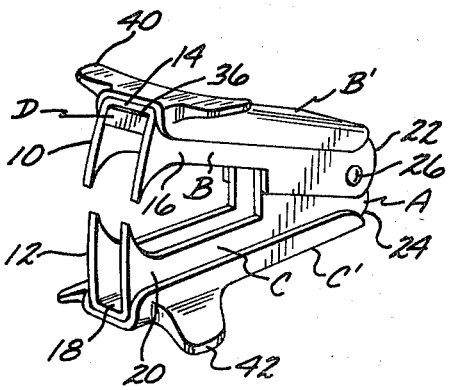
FIG. 2
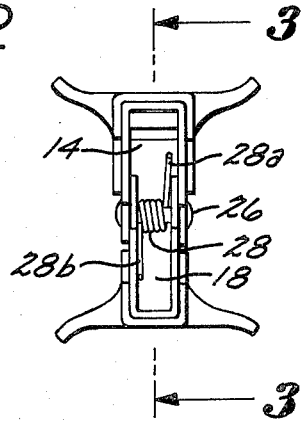
FIG. 3
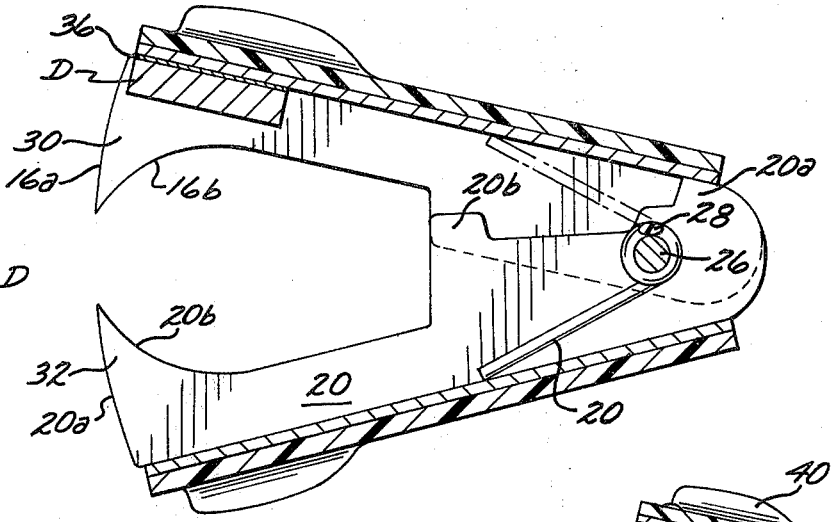
FIG. 4
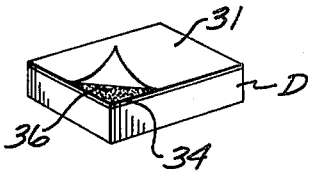
FIG. 6
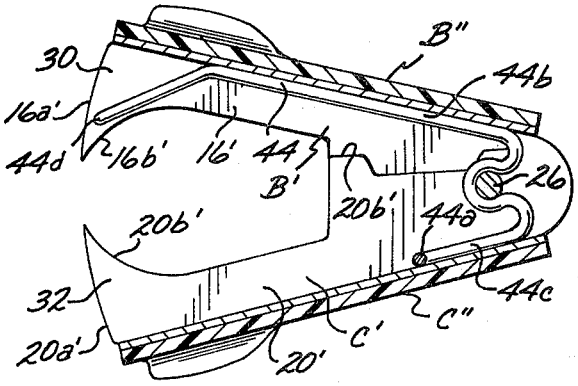
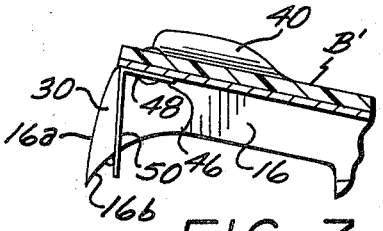
FIG. 7
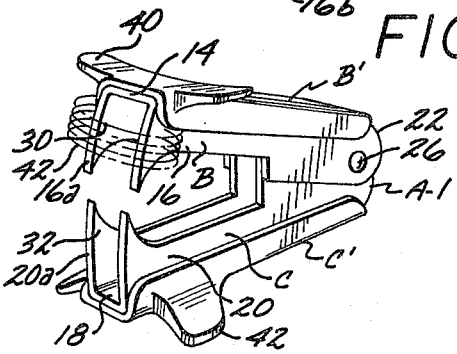
FIG. 5

COMBINED STAPLE REMOVING AND RETRIEVING DEVICE

BACKGROUND OF THE INVENTION

1. Field of the Invention

Combined staple removing and retrieving device.

2. Description of the Prior Art

For many years staples have been removed from papers through which they extend by a device that includes first and second spring loaded, pivotally connected first and second members that are of channel shaped transverse cross section, which members define first and second claws on first end portions thereof. The first and second claws when the members are pivoted to a second position overlap one another and due to curved edge surfaces defined on the first and second claws, the staple after being engaged with the claws is forced outwardly from the papers through which it extends due to the pulling action exerted thereon by the first and second claws as the latter are pivoted towards one another.

Devices of the above described structure have the operational advantage that they are simple and easy to use in removing staples from paper engaging positions, but having the operational disadvantage that the staples after being removed fall by gravity from the device onto a floor surface. In the event the floor surface is covered with a carpet, the staples due to the sharp end portions thereof become embedded in the carpet by pressure contact with shoes as persons walk on the carpet. The staples after becoming wholly or partially embedded in the carpet are removed therefrom only with greater difficulty. The staples when wholly or partially embedded in the carpet present a hazard in that they may seriously scratch a persons hands or feet by contact therewith, and the staples also impart an unsightly appearance to the carpet when they are partially embedded therein.

The primary purpose in devising the present invention is to provide means whereby a conventional staple removing device such as is now commercially sold may be transformed to retrieve and hold the removed staples thereon, and the staples thus prevented from falling onto carpeting and becoming embedded therein.

Another object of the invention is to supply a combined staple removing and staple retrieving device that is of the general structure previously identified, but one in which permanent magnetized ferrous spring means serve not only to hold the first and second members in which the first and second claws are defined in a first position, but with the spring means retrieving and holding a removed staple after the first and second members have been pivoted to a second position where the first and second claws overlap when in engagement with the staple and remove the staple from a number of papers with which it is in engagement.

A still further object of the invention is to supply a staple removing device, which has a spring means so operatively associated therewith that a staple is retrieved and held on the device after the device has removed the staple from engagement with a number of papers.

SUMMARY OF THE INVENTION

A staple removing and retrieving device that includes first and second elongate members of transverse channel shaped cross section that define first and second claws on first ends thereof, with the second ends of the first and second members being pivotally connected by a pin that extends transversely therethrough, and the device including spring means that at all times tend to hold the device in a first position where the first and second claws are separated from one another. When the device has the first and second claws spaced on opposite sides of a staple that extends through a number of papers, the first and second members are pivoted from the first position towards the second position to exert an upward force on the staple due to contact with curved edge surfaces of the first and second claws.

The staple after being removed is retrieved and held on the device by a permanent magnet that is preferably rectangular in shape and is supported in a fixed position between the side walls of one of the first and second members, adjacent the first ends thereof. The permanent magnet may be held in this fixed position by an adhesive film that covers one side thereof and is in bonding contact with an interior surface of the channel shaped member within which the magnet is disposed. The permanent magnet magnetizes at least one of the first and second claws with which it is associated to retrieve and hold a staple thereon after the device has removed the staple from engagement with a number of papers.

In a second form of the invention at least one of the first or second claws is permanently magnetized, with the claws serving the dual function of removing a staple from a fastening position, but retrieving and holding the removed staple on the invention.

In a third form of the invention, the spring means are formed from a ferrous permanently magnetic material, which spring means is of such shape that it not only serves to hold the first and second members in the previously described first position but also serves to retrieve and hold the removed staple on one of the first or second claws after the staple has been disengaged from the papers through which it previously extends, and the staple so held on the device being removed therefrom by the user of the invention.

A third form of the invention also includes first and second elongate members that are of transverse channel shaped cross section that define first and second claws on first and second ends thereof and the members on second ends being pivotally connected by transverse pins.

A resilient clip is supported on the interior end portion of either the first or second member adjacent the first and second claws defined thereon, and the clip cooperating with either the first or second jaw with which it is associated to removably grip the staple that has been disengaged from a number of papers on the jaw, and the removed staple accordingly not falling onto a carpeted floor to become either wholly or partially embedded in the carpet.

BRIEF DESCRIPTION OF THE DRAWINGS

FIG. 1 is a perspective view of a conventional staple remover that has been transformed to retrieve and hold the staple after it has been removed from a fastening position in a number of sheets of paper;

FIG. 2 is an end elevational view of the combined staple remover and staple retrieving device shown in FIG. 1;

FIG. 3 is a longitudinal cross sectional view of the device shown in FIG. 1;

FIG. 4 is a perspective view of a permanent magnet body having an adhesive covered surface, which magnet body may be bonded to the device shown in FIG. 1 for the device to retrieve and hold a staple after the latter has been removed from a paper fastening position;

FIG. 5 is a perspective view of a second form of staple removing and retrieving device;

FIG. 6 is a longitudinal cross sectional view of a third form of staple removing and staple retrieving device;

FIG. 7 is a fragmentary longitudinal cross sectional view of a fourth form of staple removing and staple retrieving device.

DESCRIPTION OF THE PREFERRED EMBODIMENT

A commercially available staple remover A is shown in FIG. 1 that includes first and second elongate members B and C that have first ends 10 and 12 respectively. The first member B is of channel shaped transverse cross section and is defined by a web 14 that has a pair of parallel, laterally spaced side walls 16 extending outwardly from the longitudinal edges thereof.

The second elongate member C is likewise of transverse, channel shaped cross section, and includes a web 18 that has a pair of parallel laterally spaced side walls 20 extending from the longitudinal edges thereof towards the side walls 16. Second end portions 22 and 24 of the first and second elongate members B and C have the rearward portions of the pairs of side walls 16 and 20 overlap one another. The first and second members B and C are supported in pivotal relationship with one another by a transverse rivet 26 that extends through transversely aligned openings (not shown) in the rearward portion of the pairs of side walls 16 and 20 as illustrated in FIG. 2.

A tensioned helical spring 28 extends above the rivet 26, and the spring having elongate end portions **28*a* and 28*b* extending therefrom that engage the interior surfaces of the webs 14 and 18 to at all times tend to maintain the staple remover A in the first position shown in FIG. 1. The side walls 20 on the second end portions thereof have upwardly extending stops 20*a* formed thereon that are engaged by the rearward interior surface of the web 14 when the first member B has been pivoted by spring 28 to the first position shown in FIG. 3. Side walls 20 have second stops 20*b* formed thereon that are engaged by the interior surface of the web 14 when first and second members B and C are pivoted towards one another to a second position. The first end portions of the first and second pairs of side walls 16 and 20 are formed to define first and second claws 30 and 32 as shown in FIG. 3. The first pair of claws 30 is defined on the first pair of side walls 16 by convex end edges 16*a* and concave side edges 16*b*. The second claws 32 are defined on the second pair of side walls 20 by convex end edges 20*a* and concave edge portions 20*b*.**

A permanent magnet D, preferably formed from a ceramic material, in the form of a rectangular block is provided, which block has a first flat surface 34 that is covered by a film 36 of pressure sensitive adhesive, and this film having a protective sheet 38 of paper or the like lightly adhered thereto. The protective sheet 38 is removed from the magnet D and the film of adhesive 36 is pressed into contact with the interior surface of the web 14 adjacent the first end 10 of first member B, to adhere the magnet D to the first member B in the position shown in FIG. 1.

The first member B has the web 14 and side walls 16 thereof formed from steel or a ferrous material that is magnetized by the presence of the magnet D when disposed on the first member B in the position shown in FIG. 1. When the first and second members B and C are pivoted from the first position shown in FIG. 1 to a second position in which the first and second claws 30 and 32 engage a staple (not shown) and remove it from a stack of papers (not shown) that are held together by the staple, the staple after it has been removed is attracted to the first claw 30. The removed staple is thus retrieved, and held on the edges **16*a* of the first member B due to the magnet D maintaining a magnetic field on the two side walls 16 and web 14.** It will, of course, be apparent that for the staple (not shown) to be retrieved and held on the invention as above described, that the staple must be formed from steel or a magnetically attractable material.

The first and second members B and C have second elongate channel shaped members B′ and C′ adhered to the exterior surface thereof, with these second channel shaped members preferably being formed from plastic and having wings 40 and 42 projecting therefrom, which wings may be pressure contacted by the thumb or fingers of a user (not shown) for removing a staple (not shown) from a stack of papers from which the staple is engaged.

A second form A-1 of the invention is shown in FIG. 5 that is identical to the first staple remover A other than that it does not employ the magnet D. In the second form A-1 the first elongate member B is permanently magnetized, with the first end of the first member B defining a U-shape magnet that has a field 42 that attracts and retrieves the staple (not shown) onto the first end 10 of the first elongate member B.

A third form A-2 of the invention is shown in FIG. 6 that is identical with the first form A, other than the second form A-2 does not employ the magnet D illustrated in FIG. 4. Also, the second form A-2 the helical spring 22 is eliminated. Elements in the third form A-2 that are common to the first form A are identified by the same letters and numerals previously used, but with primes being added thereto. In the third form A-2 a length of permanently magnetized wire 44 is bent to define an elongate U having a transverse web portion **44*a* that has two laterally spaced legs 44 extending therefrom, which legs as can be seen in FIG. 6 are formed to permanently engage the rivet 26. The legs 44 have a first and second segments 44*b* and 44*c* that are at all times in pressure contact with the interior surfaces of the webs 14 and 18, and tend to maintain the third form A-2 of the staple remover in the first position shown in FIG. 6. The segments 44*b* terminate in end portions 44*c* that are magnetized and adjacently disposed to the first claw 30. The ends 44*c* due to the proximity of the end extremities of the first claw 30 serves to magnetically attract and retrieve the removed staple (not shown) into a transverse position on the first claw 30** where it may be removed therefrom by the use of the device.

A fourth form A-3 of the invention is shown in FIG. 7 that is identical to the first form A other than that it does not use the magnet D. Instead, a resilient clip 46 is provided that is of narrower width than the space between the first pair of side walls 16, and the clip includes a first leg 48 that is secured to the interior surface of the web 14 adjacent the first end 10 by conventional means (not shown). A second leg 50 of clip 46 extends downwardly between the first pair of side walls 16. The edges 16*b* of the first elongate member B and the second leg 50 of the clip 46 cooperate to frictionally grip a removed staple 52 therebetween after the staple is removed from a holding position on a number of sheets of paper (not shown).

The use and operation of the various forms of the invention have been described previously in detail and need not be repeated.

I claim:

1. A staple removing and retrieving device, comprising:

a. first and second elongate ferrous members of channel shaped transverse cross sections that have first overlapping pivotally connected end portions and second end portions that define first and second pairs of claws, said first and second claws having inwardly disposed first and second concave edges, said second concave edges being insertable beneath the crown portion of a staple when said first and second claws and first and second members are in a first position in which said first and second claws are spaced from one another, said first concave edges moving under said crown to remove said staple when said first and second members and first and second claws move towards a second position in which said first and second jaws overlap;

b. a permanent magnet of such size as to be disposed within the confines of said first member adjacent said first pair of jaws; and c. means for holding said permanent magnet within said first member to permit said magnet to magnetize said first pair of jaws to cause said staples to removably adhere to said first pair of jaws when said first and second elongate members and first and second pairs of jaws pivot from said second to said first position.

2. A staple removing and retrieving device as defined in claim 1 in which said means is a film of pressure sensitive adhesive on at least one surface of said permanent magnet that bonds said permanent magnet to an interior surface of said first elongate ferrous member of channel shaped transverse cross section.

3. A staple removing and retrieving device as defined in claim 1 in which said means is pressure exerted by said first pair of claws to frictionally grip said permanent magnet therebetween.

* * * * *